US009751194B2

(12) United States Patent
Hussain et al.

(10) Patent No.: US 9,751,194 B2
(45) Date of Patent: Sep. 5, 2017

(54) DUAL ENDED TWEEZER

(71) Applicants: Muhammad Hussain, Highland Park, NJ (US); Farah Hussain, Highland Park, NJ (US)

(72) Inventors: Muhammad Hussain, Highland Park, NJ (US); Farah Hussain, Highland Park, NJ (US)

( * ) Notice: Subject to any disclaimer, the term of this patent is extended or adjusted under 35 U.S.C. 154(b) by 239 days.

(21) Appl. No.: 14/803,494

(22) Filed: Jul. 20, 2015

(65) Prior Publication Data

US 2016/0279766 A1 Sep. 29, 2016

Related U.S. Application Data

(63) Continuation-in-part of application No. 29/521,395, filed on Mar. 23, 2015, now Pat. No. Des. 753,881.

(51) Int. Cl.
*A45D 29/02* (2006.01)
*B25B 9/02* (2006.01)
*A45D 26/00* (2006.01)

(52) U.S. Cl.
CPC ..... *B25B 9/02* (2013.01); *A45D 26/0066* (2013.01); *A45D 29/02* (2013.01)

(58) Field of Classification Search
CPC ..... A45D 26/0066; A45D 29/02; B25B 9/02
See application file for complete search history.

(56) References Cited

U.S. PATENT DOCUMENTS

| | | | | | |
|---|---|---|---|---|---|
| 2,999,505 | A * | 9/1961 | Herstedt | A45D 29/02 | 132/73.5 |
| D227,040 | S * | 5/1973 | Lockwood | D24/143 | |
| 5,806,186 | A * | 9/1998 | Langman | A45D 29/02 | 132/75.5 |
| 5,926,956 | A * | 7/1999 | Langman | A45D 29/02 | 132/75.5 |
| D456,076 | S * | 4/2002 | Tyler | D24/143 | |
| D521,685 | S * | 5/2006 | Cho | D28/55 | |
| D532,553 | S * | 11/2006 | Ross | D24/143 | |
| D559,457 | S * | 1/2008 | Garland | D28/55 | |
| D575,904 | S * | 8/2008 | Iqbal | D24/143 | |
| 8,262,144 | B2 * | 9/2012 | Lee | B25B 9/02 | 294/2 |
| 2006/0129187 | A1 * | 6/2006 | Cho | A45D 26/0066 | 606/210 |
| 2008/0168656 | A1 * | 7/2008 | Cho | A45D 29/02 | 30/28 |

* cited by examiner

*Primary Examiner* — David B Thomas

(57) ABSTRACT

A dual ended tweezer a first lateral arm and a second lateral arm connected by a connecting arm. The connecting arm acts as a transversal between the first lateral arm and the second lateral arm, which are parallel, thus forming a "Z" shape. A first pinching tip pair is connected at a first end and a second pinching tip pair is connected at a second end to the lateral arms. The first and second pinching tip pair may be embodied as any of a variety of tweezer tip types, providing a number of different combinations of dual tweezer functionality.

14 Claims, 19 Drawing Sheets

DUAL ENDED TWEEZER

The current application is a continuation in part of U.S. Design patent application Ser. No. 29/521,395 filed on Mar. 23, 2015.

FIELD OF THE INVENTION

The present invention relates generally to cosmetic, surgical, dental and hobby tools and implements. More particularly, the present invention relates to tweezers.

BACKGROUND OF THE INVENTION

Human hands are very useful for many tasks of manual manipulation of physical objects, but some objects are too small to handle easily bare-handed. When an object too small to be handled easily with human hands is encountered, tweezers are typical instruments that is useful to such a task. Typical tweezers are a pinching implement making use of two third-class levers connected at one fixed end, the fulcrum point of each lever, with pinching tips at the opposite end.

Tweezers have many uses. One common use for tweezers is in cosmetics and beauty, including plucking pair from the face or eyebrows, applying fake eyelashes, and fixing jewelry. Other cases of manipulating small objects for which tweezers are useful or essential are removing splinters, manipulating surface-mount electronic parts and small mechanical parts for models and precision mechanisms such as watches. Other specialized uses for tweezers include picking out gold flakes in gold panning, and removing bones from fish fillets in a process known as pin boning. Tweezers may also be used in various medical and dental procedures, among many other applications.

Tweezers can have many different types of tips for different applications. For example, tweezer tips typically used for cosmetics and beauty include slanted tip, pointed tip, pointed-slant tip, round tip, flat tip, and jagged tip. Each one is more particularly suited to various applications than others, such as removing different lengths and types of hairs, applying cosmetic products such as fake eyelashes, removing splinters, and providing various degrees of precision and control. Tweezers also have many applications in dental and surgical fields, such as picking up gauze and holding needles in the operating room.

The object of the present invention is to provide a double-ended tweezer that is able to combine multiple types of tweezer tips for multiple applications in a single implement.

DETAIL DESCRIPTIONS OF THE INVENTION

All illustrations of the drawings are for the purpose of describing selected versions of the present invention and are not intended to limit the scope of the present invention. The present invention is to be described in detail and is provided in a manner that establishes a thorough understanding of the present invention. There may be aspects of the present invention that may be practiced without the implementation of some features as they are described. It should be understood that some details have not been described in detail in order to not unnecessarily obscure focus of the invention.

The present invention is a double ended tweezer for multifunction purposes. Different types of tweezer ends are more suited to different applications. The double ended nature of the present invention allows a single tweezer implement to comprise two types of tweezer tips in order to perform two or more tweezer related functions.

Figure 1:
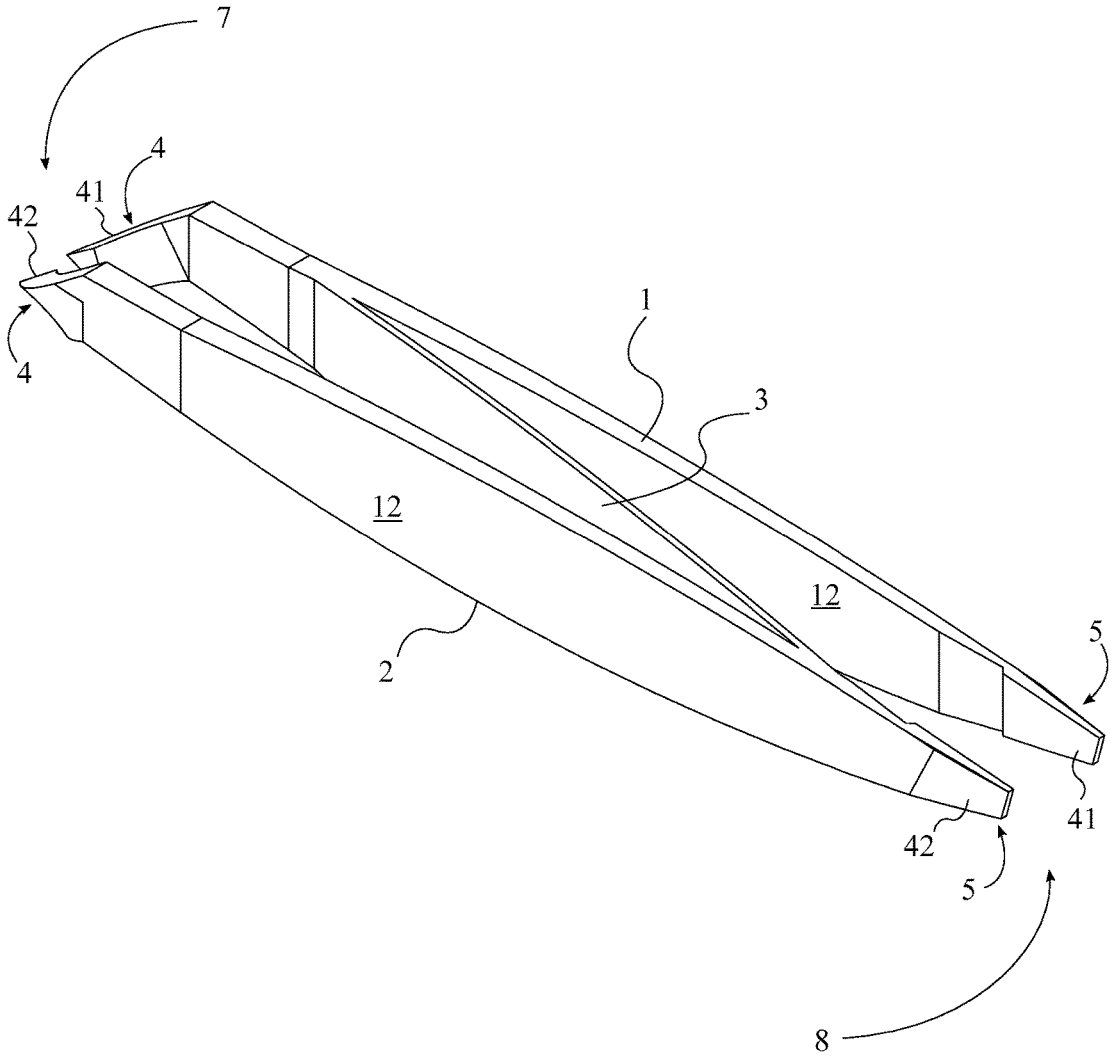
FIG. 1 is a perspective view of one embodiment of the present invention.
Figure 2:
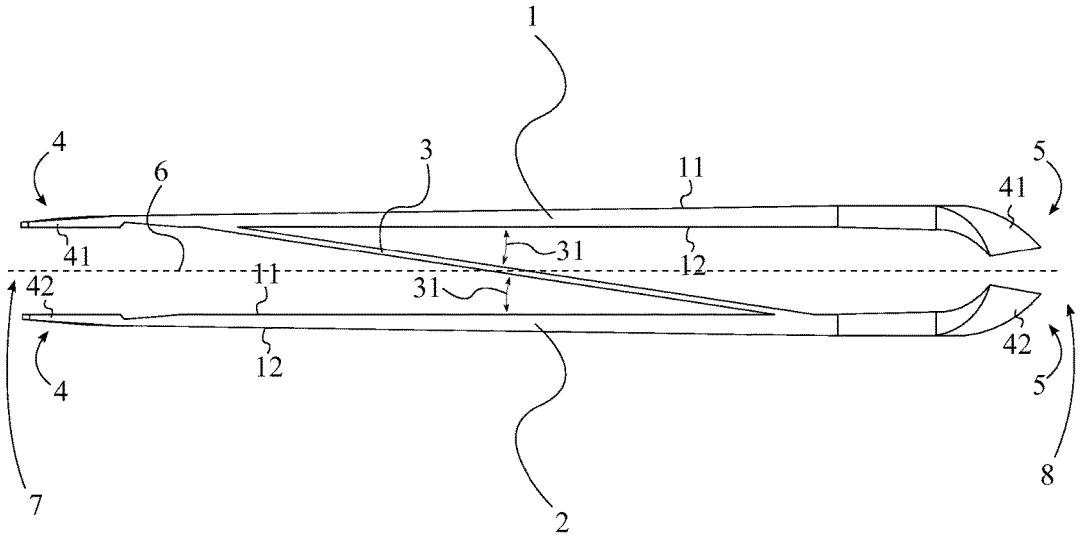
FIG. 2 is a side view of the embodiment of FIG. 2.
Figure 3:
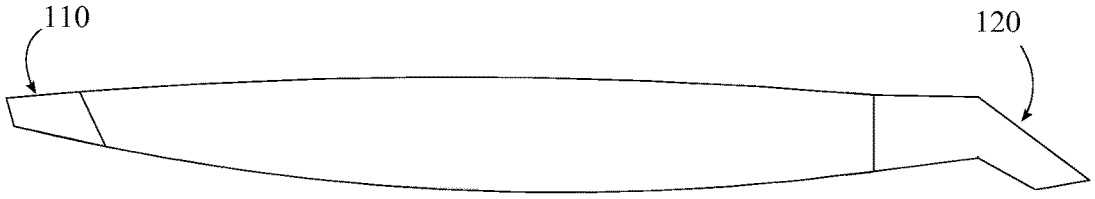
FIG. 3 is a top view of the embodiment of FIG. 2.
Figure 4:
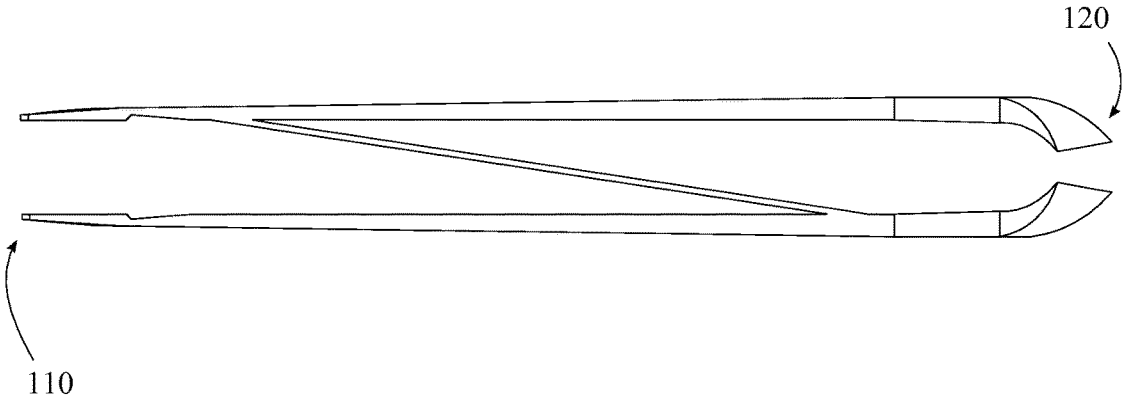
FIG. 4 is another side view of the embodiment of FIG. 2.

Referring to FIGS. 1-3, in general, the preferred embodiment of the present invention comprises a first lateral arm 1, a second lateral arm 2, a connecting arm 3, a first pinching tip pair 4 and a second pinching tip pair 5. The first lateral arm 1 and the second lateral arm 2 are oriented parallel to each other and a central axis 6. The central axis 6 is an imaginary line about which the first lateral arm 1 and the second lateral are positioned equidistantly opposite to each other in the preferred embodiment. A first end 7 and a second end 8 are positioned opposite each other along the central axis 6, at extremities of the first lateral arm 1 and the second lateral arm 2.

In the preferred embodiment of the present invention, the first lateral arm 1 and the second lateral arm 2 each comprise a first side 11 and a second side 12. The first side 11 and the second side 12 of the first lateral arm 1 and the second lateral arm 2 are oriented parallel to the central axis 6. The first side 11 and the second side 12 are positioned opposite and parallel to each other on the first lateral arm 1 and the second lateral arm 2. In the preferred embodiment, the first side 11 and the second side 12 of the first lateral arm 1 and the second lateral arm 2 are flat, or substantially flat. The first lateral arm 1 and the second lateral arm 2 may be embodied with slight curves, inflection points or other geometric features that facilitate ease of use or aesthetics, but the first lateral arm 1 and the second lateral arm 2 are substantially flat, thin and elongated.

The connecting arm 3 is connected at an arm connecting angle 31 to the first lateral arm 1 and the second lateral arm 2. The connecting arm 3 is preferably connected to the second side 12 of the first lateral arm 1 adjacent to the first end 7, and the connecting arm 3 is connected to the first side 11 of the second lateral arm 2 adjacent to the second end 8. In the preferred embodiment of the present invention, the arm connecting angle 31 is an acute angle measured clockwise from the second side 12 of the first lateral arm 1 to the connecting arm 3 and counterclockwise from the first side 11 of the second lateral arm 2 to the connecting arm 3. This arrangement provides squeezing functionality at both the first end 7 and the second end 8.

In the preferred embodiment, the first pinching tip pair 4 and the second pinching tip pair 5 each comprise a first tip 41 and the second tip 42. The functionality of the present invention is realized when a user applies compressive force to the first lateral arm 1 and the second lateral arm 2 near the first end 7 or second end 8 in order to bring together the first tip 41 and the second tip 42, thereby clasping an object between the first tip 41 and the second tip 42 for manual manipulation.

The first tip 41 of the first pinching tip pair 4 is connected to the first lateral arm 1 at the first end 7, and the second tip 42 of the first pinching tip pair 4 is connected to the second lateral arm 2 at the first end 7. Similarly, the first tip 41 of the second pinching tip pair 5 is connected to the first lateral arm 1 at the second end 8, and the second tip 42 of the second pinching tip pair 5 is connected to the second lateral arm 2 at the second end 8.

The first pinching tip pair 4 and the second pinching tip pair 5 may take a number of different forms that are more appropriate for various specialized applications. In one embodiment, the first pinching tip pair 4 is a slanted tweezer end pair 110. In another embodiment, the first pinching tip pair 4 is a straight tweezer end pair 112. In another embodiment, the first pinching tip pair 4 is a curved head pair with straight ends 114. In another embodiment, the first pinching tip pair 4 is a curved head pair with slanted ends 116. In another embodiment, the first pinching tip pair 4 is a nail clipper head 118.

Additionally, in one embodiment the second pinching tip pair 5 is a tweezer nipper end pair 120. In another embodiment the second pinching tip pair 5 is a pointed end pair 122. In another embodiment, the second pinching tip pair 5 is a slanted tweezer end pair 110. In another embodiment the second pinching tip pair 5 is a curved head pair with straight ends 114. In another embodiment the second pinching tip pair 5 is a curved head pair with slanted ends 116.

Figure 5:
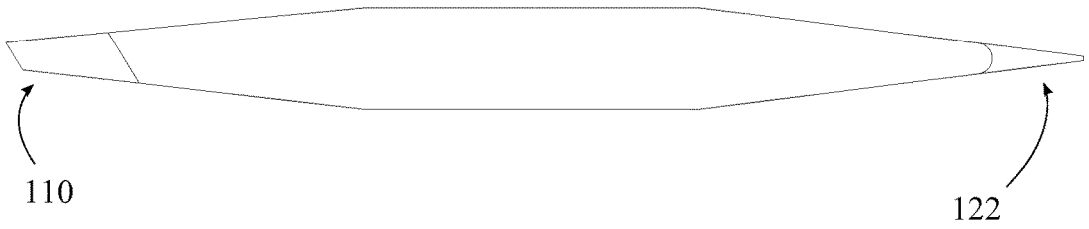
FIG. 5 is a top view of a second embodiment of the present invention.
Figure 6:
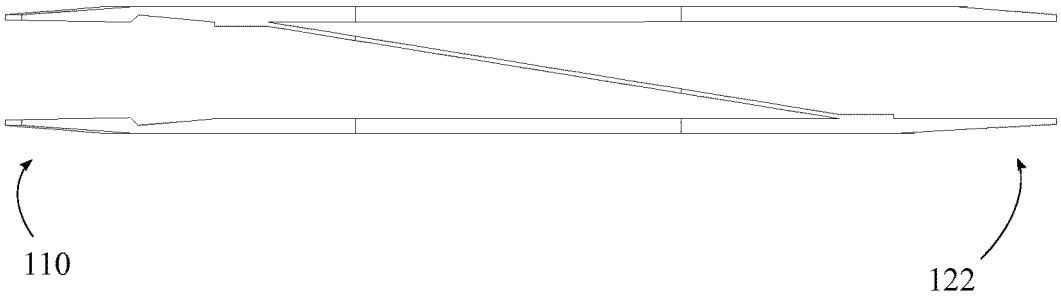
FIG. 6 is a side view of the second embodiment.
Figure 7:
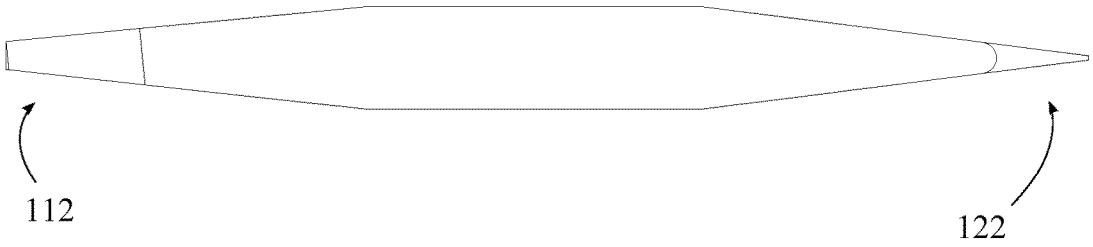
FIG. 7 is a top view of a third embodiment of the present invention.
Figure 8:
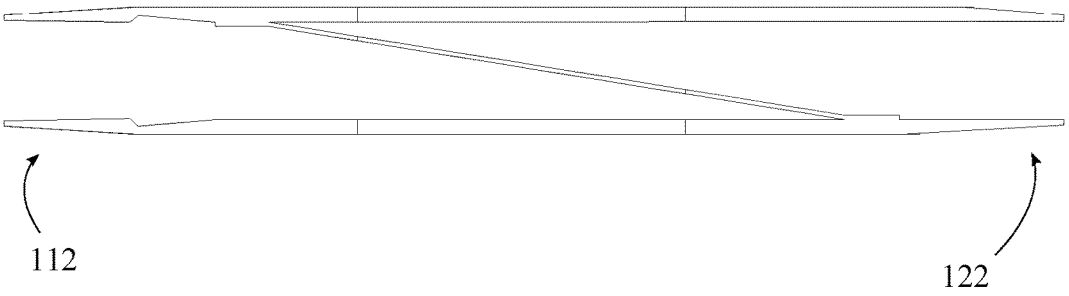
FIG. 8 is a side view of the third embodiment.
Figure 9:
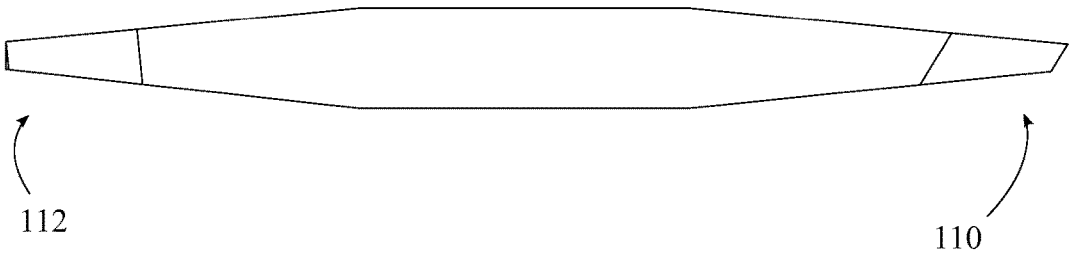
FIG. 9 is a top view of a fourth embodiment of the present invention.
Figure 10:
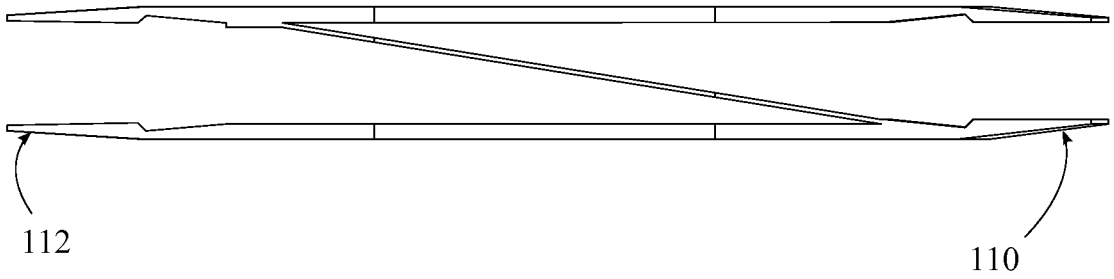
FIG. 10 is a side view of the fourth embodiment.
Figure 11:
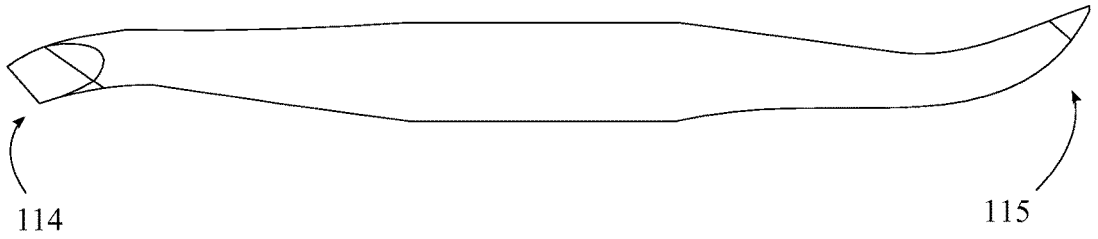
FIG. 11 is a top view of a fifth embodiment of the present invention.
Figure 12:
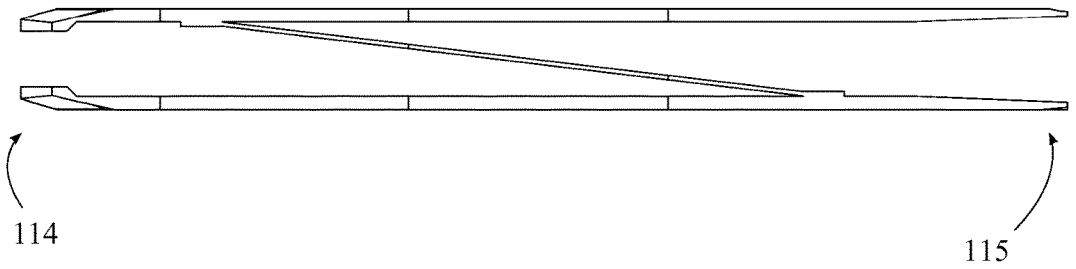
FIG. 12 is a side view of the fifth embodiment.
Figure 13:
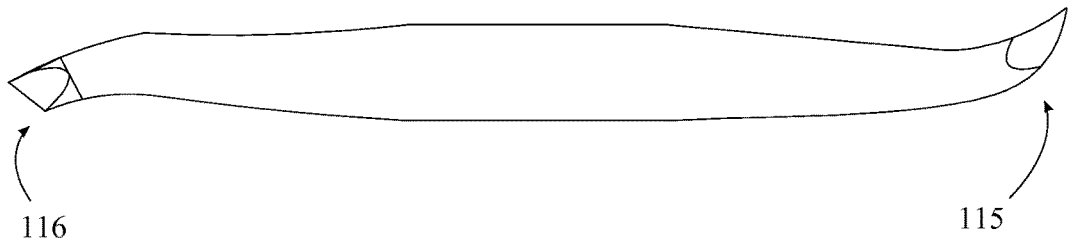
FIG. 13 is a top view of a sixth embodiment of the present invention.
Figure 14:
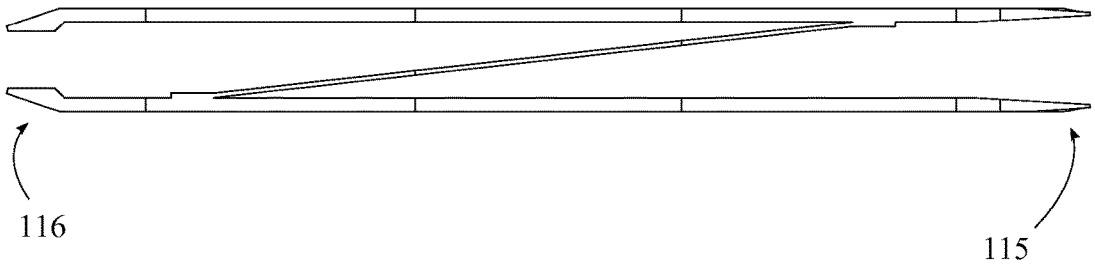
FIG. 14 is a side view of the sixth embodiment.
Figure 15:
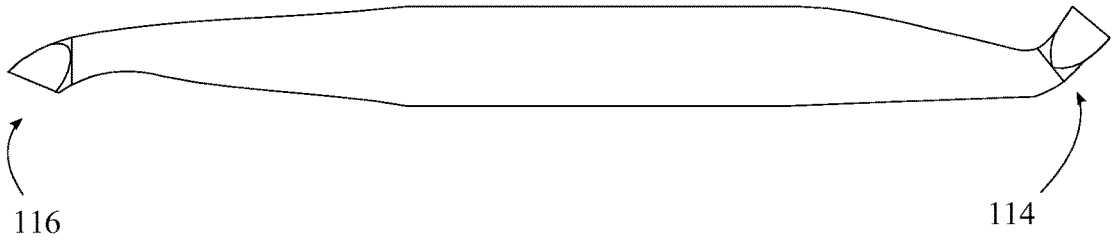
FIG. 15 is a top view of a seventh embodiment of the present invention.
Figure 16:
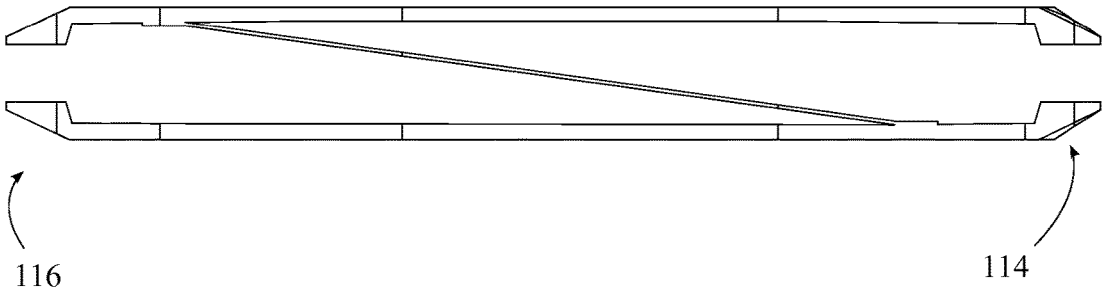
FIG. 16 is a side view of the seventh embodiment.
Figure 17:
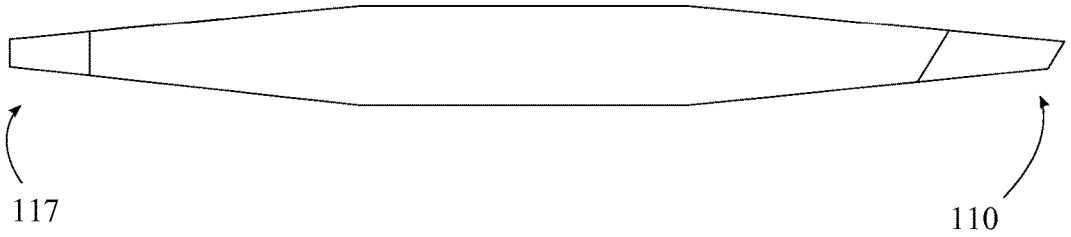
FIG. 17 is a top view of an eighth embodiment of the present invention.
Figure 18:
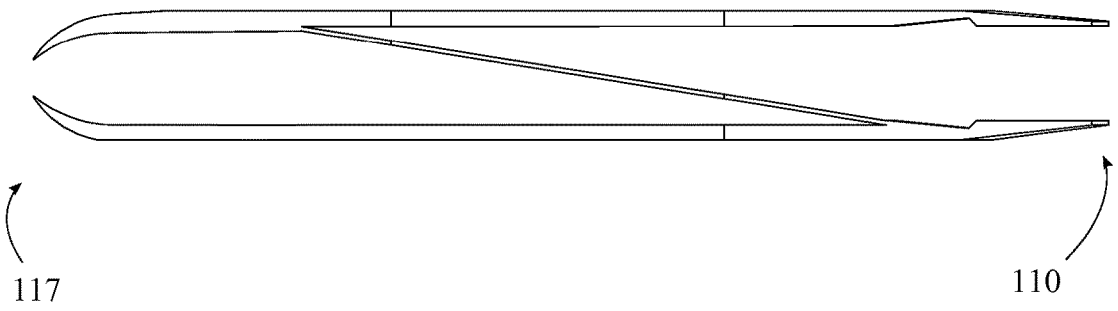
FIG. 18 is a side view of the eighth embodiment.

Combining the above embodiments for the first pinching tip pair 4 and the second pinching tip pair 5 results in a plurality of desired embodiments for the present invention. In a first preferred embodiment of the present invention shown in FIGS. 1-4, the first pinching tip pair 4 is a slanted tweezer end pair 110 and the second pinching tip pair 5 is a tweezer nipper end pair 120. In a second embodiment shown in FIGS. 5-6, the first pinching tip pair 4 is a slanted tweezer end pair 110 and the second pinching tip pair 5 is a pointed end pair 122. In a third embodiment shown in FIGS. 7-8, the first pinching tip pair 4 is a straight tweezer end pair 112 and the second pinching tip pair 5 is a pointed end pair 122. In a fourth embodiment shown in FIGS. 9-10, the first pinching tip pair 4 is a straight tweezer end pair 112 and the second pinching tip pair 5 is a slanted tweezer end pair 110. In a fifth embodiment shown in FIGS. 11-12, the first pinching tip pair 4 is a curved head pair with straight ends 114 and the second pinching tip pair 5 is a curved head pair with pointed ends 115. In a sixth embodiment shown in FIGS. 13-14, the first pinching tip pair 4 is a curved head pair with slanted ends 116 and the second pinching tip pair 5 is a curved head pair with pointed ends 115. In a seventh embodiment shown in FIGS. 15-16, the first pinching tip pair 4 is a curved head pair with slanted ends 116 and the second pinching tip pair 5 is a curved head pair with straight ends 114. In an eighth embodiment shown in FIGS. 17-18, the first pinching tip pair 4 is a nose tweezer end pair 117 with inwardly curving ends and the second pinching tip pair 5 is a slanted tweezer end pair 110.

Figure 19:
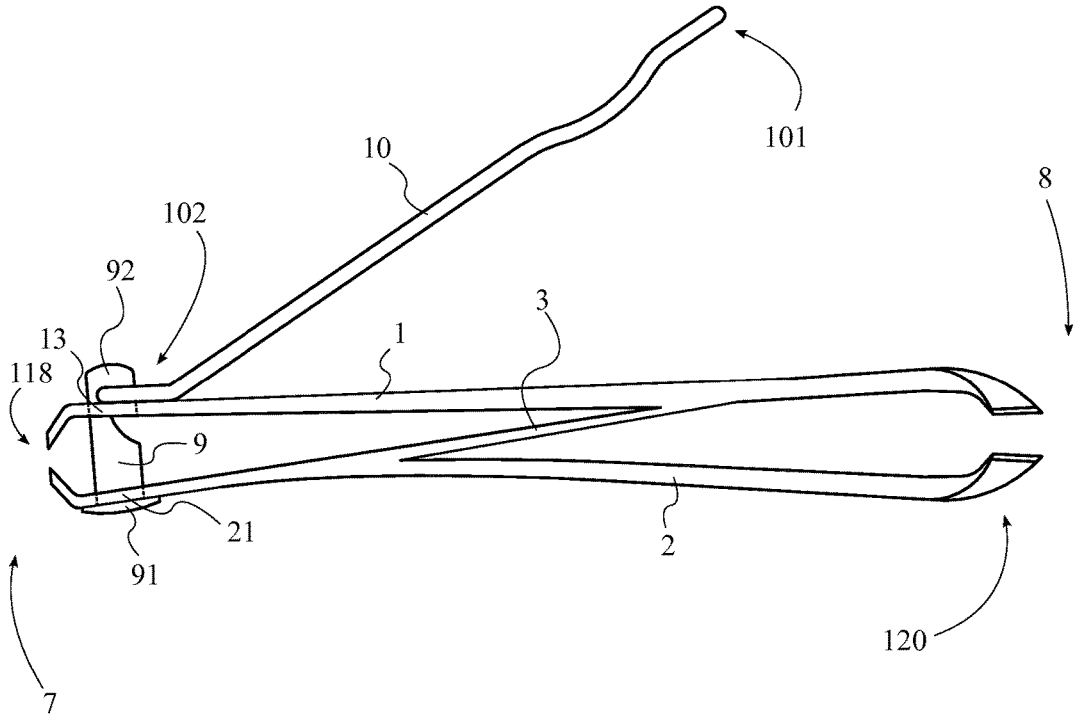
FIG. 19 is a side view of a ninth embodiment incorporating a nail clipper head.

In a ninth embodiment shown in FIG. 19, the present invention additionally comprises a holding pin 9 and a lever arm 10 to incorporate the functionality of nail clippers. In the embodiment shown in FIGS. 19-20, the connecting arm 3 is connected to the first lateral arm 1 adjacent to the second end 8 and to the second lateral arm 2 adjacent to the first end 7. The holding pin 9 comprises a pin head 91 and a lever attachment end 92 positioned opposite each other along the holding pin 9. The lever arm 10 comprises a proximal end 101 and a distal end 102 positioned opposite each other along the lever arm 10. Additionally, the first lateral arm 1 comprises a first pin aperture 13, and the second lateral arm 2 comprises a second pin aperture 21. The first pin aperture 13 and the second pin aperture 21 are positioned adjacent to the first end 7 between the first pinching tip pair 4 and the connecting arm 3. The holding pin 9 traverses through both the first pin aperture 13 and the second pin aperture 21 and is rotatable within the first pin aperture 13 and the second pin aperture 21. The lever attachment end 92 of the holding pin 9 is positioned adjacent to the first side 11 of the first lateral arm 1 opposite the second side 12 of the first lateral arm 1, and the pin head 91 of the holding pin 9 is positioned adjacent to the second side 12 of the second lateral arm 2 opposite the first side 11 of the second lateral arm 2. The distal end 102 of the lever arm 10 is connected to the lever attachment end 92 of the holding pin 9. The lever arm 10 is rotatably connected to the holding pin 9 so that the angle between the holding pin 9 and the lever arm 10 may be changed in order to maneuver the lever arm 10 between an operating position and a storage position as is common with nail clippers. The pin head 91 and the distal end 102 hold the holding pin 9 in place, and a user may apply force to the proximal end 101 in order to apply leverage force to the first lateral arm 1 and second lateral arm 2 in order to squeeze the first tip 41 and the second tip 42 of the first pinching tip together. In this case, the first pinching tip pair 4 is a nail clipper head 118 as is common with nail clippers. The second pinching tip pair 5 may be any of the aforementioned embodiments of tweezer tip pairs, but in particular, in this ninth embodiment the second pinching tip pair is a tweezer nipper end pair 120. The tweezer nipper end pair 120 is also commonly known as a cuticle nipper due to its typical application in trimming cuticles of the finger.

It should be noted that although several specific embodiments comprising different combinations of pinching tips have been disclosed, any other desired combination of types of pinching tips may also be comprised in the present invention.

Although the invention has been explained in relation to its preferred embodiment, it is to be understood that many other possible modifications and variations can be made without departing from the spirit and scope of the invention as hereinafter claimed.

What is claimed is:

1. A multifunction/double ended tweezer comprises:

a first lateral arm;

a second lateral arm;

a connecting arm;

a first pinching tip pair;

a second pinching tip pair;

a first end;

a second end;

a central axis;

the first pinching tip pair and the second pinching tip pair each comprise a first tip and a second tip;

the first lateral arm and the second lateral arm being oriented parallel to each other and the central axis;

the first lateral arm and the second lateral arm being positioned equidistantly opposite each other about the central axis;

the connecting arm being connected at an arm connecting angle to the first lateral arm and the second lateral arm;

the first end and the second end being positioned opposite each other along the central axis;

the first tip of the first pinching tip pair being connected to the first lateral arm at the first end;

the second tip of the first pinching tip pair being connected to the second lateral arm at the first end;

the first tip of the second pinching tip pair being connected to the first lateral arm at the second end;

the second tip of the second pinching tip pair being connected to the second lateral arm at the second end; and the first pinching tip pair being a slanted tweezer end pair.

2. The multifunction tweezer as claimed in claim 1 comprises:

the connecting arm being connected to the first lateral arm adjacent to the first end; and the connecting arm being connected to the second lateral arm adjacent to the second end.

3. The multifunction tweezer as claimed in claim 1 comprises:

the first lateral arm and the second lateral arm each comprise a first side and a second side;

the first side and the second side being oriented parallel to the central axis;

the first side and the second side being positioned opposite each other on the first lateral arm and the second lateral arm;

the connecting arm being connected to the second side of the first lateral arm; and the connecting arm being connected to the first side of the second lateral arm.

4. The multifunction tweezer as claimed in claim 3 comprises:

the first side and the second side of the first lateral arm and the second lateral arm being flat.

5. The multifunction tweezer as claimed in claim 1 comprises:

the arm connecting angle being an acute angle.

6. The multifunction tweezer as claimed in claim 1 comprises:

the arm connecting angle being an acute angle measured from the first lateral arm to the connecting arm and from the second lateral arm to the connecting arm.

7. The multifunction tweezer as claimed in claim 1 comprises:

the arm connecting angle being an acute angle measured from a second side of the first lateral arm to the connecting arm and from a first side of the second lateral arm to the connecting arm.

8. The multifunction tweezer as claimed in claim 1 comprises:

the second pinching tip pair being a tweezer nipper end pair.

9. The multifunction tweezer as claimed in claim 1 comprises:

the second pinching tip pair being a pointed end pair.

10. The multifunction tweezer as claimed in claim 1 comprises:

the second pinching tip pair being a slanted tweezer end pair.

11. The multifunction tweezer as claimed in claim 1 comprises:

the second pinching tip pair being a curved head pair with straight ends.

12. The multifunction tweezer as claimed in claim 1 comprises:

the second pinching tip pair being a curved head pair with slanted ends.

13. The multifunction tweezer as claimed in claim 1 comprises:

a holding pin;

a lever arm;

the holding pin comprises a pin head and a lever attachment end;

the lever arm comprises a proximal end and a distal end;

the first lateral arm comprises a first pin aperture;

the second lateral arm comprises a second pin aperture;

the pin head and the lever attachment end being positioned opposite each other along the holding pin;

the proximal end and the distal end being positioned opposite each other along the lever arm;

the first pin aperture and the second pin aperture being positioned adjacent to the first end;

the holding pin traversing through the first pin aperture and the second pin aperture;

the holding pin being rotatable within the first pin aperture and the second pin aperture;

the lever attachment end being positioned adjacent to the first side of the first lateral arm;

the pin head being positioned adjacent to the second side of the second lateral arm; and the distal end of the lever arm being connected to the lever attachment end of the holding pin.

14. The multifunction tweezer as claimed in claim 13 comprises:

the second pinching tip pair being a tweezer nipper end pair.

* * * * *